United States Patent [19]

Arbuzoff

[11] 4,289,243

[45] Sep. 15, 1981

[54] SUPPORT DRIVE PRIMARILY DESIGNED FOR FOOTWEAR

[76] Inventor: Nicholas A. Arbuzoff, P.O. Box 885-ONECO, Bradenton, Fla. 33558

[21] Appl. No.: 1,674

[22] Filed: Jan. 8, 1979

[51] Int. Cl.[3] ..... A47F 7/00

[52] U.S. Cl. ..... 211/35; 211/100

[58] Field of Search ..... 211/35, 38, 99, 100, 211/104, 170, 171, 34, 32, 30

[56] References Cited

U.S. PATENT DOCUMENTS

| | | | |
|---|---|---|---|
| 2,093,802 | 9/1937 | Brown | 211/35 |
| 2,412,847 | 12/1946 | Van Tilburg | 211/35 |
| 2,441,417 | 5/1948 | Hopicins | 211/100 X |
| 2,960,236 | 11/1960 | Prenveille | 211/171 X |
| 3,608,738 | 9/1971 | Andersen | 211/38 |
| 4,109,335 | 8/1978 | Randolph | 211/35 X |

FOREIGN PATENT DOCUMENTS

| | | | |
|---|---|---|---|
| 100836 | 5/1937 | Australia | 211/32 |

*Primary Examiner*—Roy D. Frazier
*Assistant Examiner*—Robert W. Gibson, Jr.
*Attorney, Agent, or Firm*—Arthur W. Fisher, III

[57] ABSTRACT

A support device of the type primarily designed to support boots and like footwear in an orientation so as to facilitate free circulation of air throughout the interior and around the entire boot thereby aiding in a rapid drying of the boot and after exposure to the elements. This support device includes a base having pivotally attached thereto one or more support arms movable into an outwardly, angularly inclined extended position. Each of the arms are specifically dimensioned and configured to be mounted on the interior of a boot and supported for rapid drying as set forth above.

2 Claims, 5 Drawing Figures

SUPPORT DRIVE PRIMARILY DESIGNED FOR FOOTWEAR

BACKGROUND OF THE INVENTION

1. Field of the Invention

A support device in the form of a rack specifically intended to have a plurality of boots mounted thereon to facilitate rapid drying of the boots after exposure to the elements.

2. Description of the Prior Art

It is well recognized that a substantial problem exists in the drying and proper treatment of footwear such as boots especially in winter time or inclement weather. Accordingly a substantial problem is presented in homes and/or offices during the winter time or such poor weather particularly because of the presence of wet boots and like shoe coverings or footwear. It is important that such footwear be properly dried in order to extend the active life of the footwear as well as making the footwear more comfortable for continued use and wearing.

In order to accomplish such drying proper drainage has to occur which further entails the proper orientation of the boots or footwear to accomplish adequate circulation of drying air around the interior and exterior portions of the boot. Attempts have been made in the past to provide for the storage of wet, icy and snowy boots or shoes but in most cases such facilities have been less than satisfactory. It is generally recognized that the mere storage of boots in their normal upright position does not effect the most efficient drying of such boots once they have been disposed to moisture or poor weather conditions.

In order to accomplish more efficient drying of such footwear many devices and/or products have been designed to support or orient the boots in an effective storage position. In numerous cases such devices have been overally complicated and accordingly expensive and further capable of storing a relatively limited number of boots. Since it is generally well known that boots and like footwear are subject to rapid deterioration when exposed to water or chemicals, etc. The importance of proper storage facilities or support devices has increased greatly. This especially is true for relatively expensive boots or footwear worn by either men or women in normal conditions or for such special applications as skiing, etc.

Support facilities of the type present in the prior art and sometimes commercially available to the general public evidenced by disclosures in the following U.S. patents: Collins, No. 3,762,573; Oblusteel, No. 2,603,393; Sitzman, No. 2,977,000; Neuwirth, No. 2,928,549; and Fisher, No. 3,775,794.

While each of the structures described in the above set forth references are operable and designed for certain applications, it is generally recognized that facilities of this type do suffer from the inherent problems of over complication of structure, excessive cost in general and efficiency.

SUMMARY OF THE INVENTION

The present invention is directed toward a support device of the type specifically designed to mount boots or like footwear thereon so as to facilitate the drying and storage of boots after exposure to moisture or inclement weather.

The support device of the present invention comprises a base means which is specifically structured and configured to be attached to any type of support surface of element such as any horizontal or vertical surface on the interior or exterior of a closet, locker, or any like facility which is convenient for the temporary storage of boots or like footwear.

The base means, in its preferred embodiment comprises a base wall and two side walls extending upwardly therefrom and substantially parallel spaced apart relation to one another.

A support arm means is mounted, in the preferred embodiment, in pivotal relation to the base means wherein the support means may be positioned either in open or closed position. Support means comprises at least one support arm having one end pivotally attached to the base means so as to allow movable positioning, in a selected fashion, of the one support arm in its open or closed position.

One embodiment of the present invention comprises the support means including a pair of support arms each having a substantially elongated configuration and specifically dimensioned configured for disposal on the interior of a boot or like footwear so as to support the boot in an inverted position but yet allow free circulation of air in and about the boot.

Various embodiments of the present invention comprise a single pair of support arms being pivotally connected to the base means for movement into and out of closed and/or open position as set forth above. Alternately a plurality of pairs of support arms are each pivotally connected, at one end thereof, to the base means for pivotal movement in planes, defined by the individual support arms wherein such planes are disposed substantially transverse of the longitudinal axis of the base means.

Irrespective of the particular embodiment utilized the individual pairs of support arms are pivotal into exposed outwardly extending relation to the base means which defines the "open" position of the support means and alternately may be positioned into its closed position substantially within the plane defined by the base means and out of an outwardly extending position relative to said base means.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
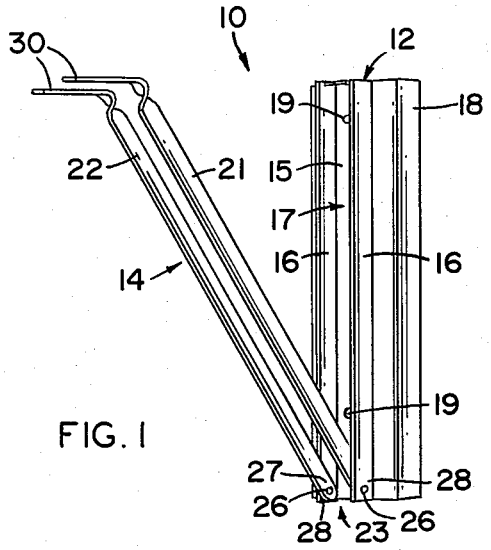
FIG. 1 is a perspective view of the support device of the present invention without footwear mounted thereon.
Figure 2:
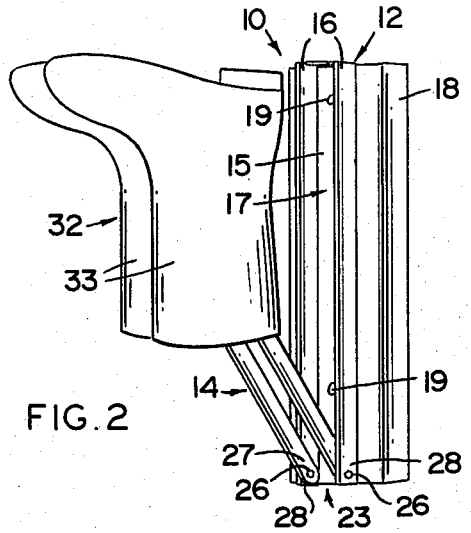
FIG. 2 is a perspective view of the support device of the present invention in its open position with footwear mounted thereon.
Figure 3:
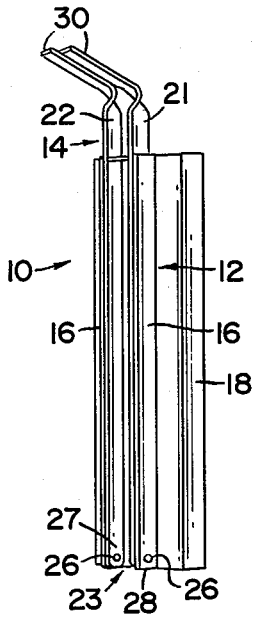
FIG. 3 is a perspective view of the present invention in closed position.

As best shown in FIGS. 1, 2 and 3 the support device of the present invention is generally indicated as 10 and comprises base means 12 and support means 14.

The base means 12 includes base wall 15 and two side walls 16 extending upwardly and outwardly therefrom. The side walls 16 are substantially elongated and extend along the major portion of the length of the base wall 15 being further disposed in spaced apart substantially parallel relation to one another. Due to the specific configuration of the side walls 16 and base wall 15 a channel means generally indicated as 17 is formed substantially in between the side walls 16.

In addition the base means 12 is specifically structured and configured to be mounted on any type of support element or support surface 18. The support surface or element 18 may take the form of any type of interior or exterior surface of a locker, closet, storage area or general facility adequate for the storage and drying of footwear through the positioning of the support means 10 thereon. A connecting aperture as at 19 may be disposed in the base wall 15 of the base means 12 for the purpose of having a conventional connector element extend therethrough into securing engagement with the support surface of element 18. As shown in FIGS. 1, 2 and 3 one embodiment of the present invention comprises the support means 14 including at least one and preferably a plurality of support arms 21 and 22. Each arm 21 and 22 is connected generally as at 23 to the base means 12. More specifically each of the arms 21 and 22 are pivotally connected by pivot points 26 disposed in interconnecting relation between one end 27 of each of the arms 21 and 22 and a correspondingly positioned portion 28 at the side walls 16.

With specific reference to FIG. 1 the opposite ends of each of the support arms 21 and 22 has an outwardly extending depending finger 30 being specifically dimensioned and configured to be disposed on the interior of the footwear generally indicated as 32 and support the interior sole portion or foot portion thereof. Accordingly, each of the support arms 21 and 22 have a substantially elongated configuration as shown so as to extend within the interior and adequately have mounted thereon the footwear 32 which may be in the form of boots having elongated calf covering portions 33.

The support arm 21 and 22 comprising the overall support means 14 is pivotally connected as at 26 to the base means 12 in a manner so as to extend angularly outwardly therefrom as shown in FIG. 1. This angularly outward extension defines the open position of the support means or support arms 21 and 22 ready to have the footwear 32 mounted thereon in supported, drying position.

With regard to FIG. 3 the support means comprising support arms 21 and 22 are shown in its "closed" position wherein the arms are pivoted about pivot points 26 so as to be folded between the side wall 16 and into the channel 17 at least partially defined thereby. Accordingly in such position as shown in FIG. 3 the support arms 21 and 22 are in their stored and not in their outwardly oriented extended position. Accordingly the support arms 21 and 22 may be positioned out of the outwardly extending relation for proper storage in a minimal amount of space.

Figure 4:
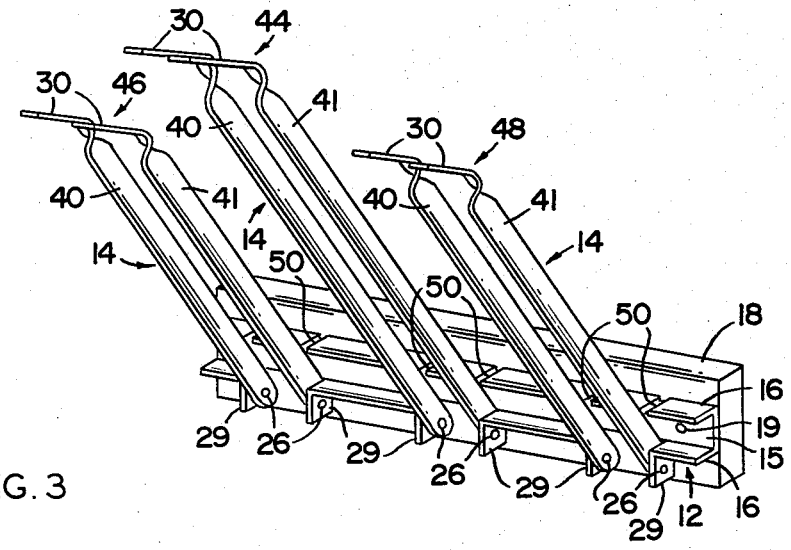
FIG. 4 is one embodiment of the present invention.
Figure 5:
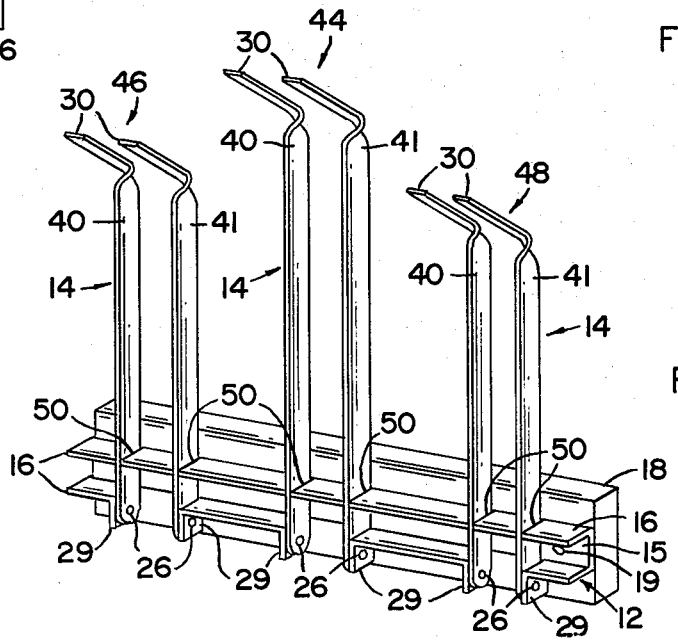
FIG. 5 is yet another embodiment of the present invention showing a plurality of support means pivotally attached to the base means of the present invention.

With regard to FIGS. 4 and 5, another embodiment of the present invention comprises the base means 12 having an elongated base wall 15 flanked by two upwardly extending side walls 16 integrally attached thereto. As set forth with the embodiment of FIGS. 1 through 3 the base means 12 is fixedly attached to a given or predetermined mounting or support surface 18. In the embodiment shown in FIGS. 4 and 5 the support means 14 each comprises a pair of support arms wherein the individual support arms of each pair are designated as 40 and 41 respectively. It will be noted that the central most pair generally indicated as 44 is somewhat larger than the outer or flanking pair 46 and 48.

Also each support arm 40 and 41 of the plurality of pairs of support arms has the outwardly depending support finger 30 extending from the free end of each of the support arms 40 and 41.

In addition, each of the support arms 40 and 41 are pivotally attached by pivot member 26 to a depending flange 29 so as to be pivotally connected to the base means and movable in a plane which is substantially transverse to the longitudinal axis of the base means. Accordingly in FIG. 4 each of the arms are shown in their outwardly angularly oriented and extended position relative to the base means. In FIG. 5 each of the arms are shown in their closed position wherein each of the arms are designed to fit back into transverse slots 50 integrally formed in the side walls so as to receive the length of the support arms 40 and 41.

By virtue of the structure the plurality of support arms comprising each of the plurality of pairs of the support arms 44, 46 and 48 are disposable both in a outwardly, extending oriented position relative to the base means 12 wherein the closed position is similarly defined in FIG. 5 showing the support arms being selectively disposable into the various slots 50 transversely located into the length of the base means 12.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A support device of the type primarily designed to dispose footwear in exposed, supported position for drying, said support device comprising: base means dimensioned and configured for secure mounting engagement with a predetermined surface, a plurality of pairs of spaced support arms disposed in spaced relation along the length of said base means, each one of said pairs of support arms individually secured to said base and disposed to extend outwardly therefrom in spaced relation to said base means, each of said support arms comprising a substantially elongated, generally flat, rectangular configuration, each of said support arms pivotally connected substantially adjacent one end thereof and comprising a footwear engaging distal end at the opposite end thereof and movable in a plane disposed substantially transverse to the longitudinal axis of said base means between an open and a closed position, said open position defined by outward, angularly oriented disposition of said arms relative to said base means, said closed position defined by a substantially co-planar relation between the longitudinal axis of said support arms and said base means, each of said support arms having a substantially 90° twist formed therein about its longitudinal axis substantially adjacent said footwear engaging distal end so that said distal end lies on a plane orthogonally disposed to said plane disposed substantially traverse to the longitudinal axis of said base means, the portion of each said support arm intermediate its distal end and said twisted portion angularly disposed relative to the longitudinal axis of said support arm so that it lies in a substantially horizontal plane thereby support footwear in an optimal position to achieve maximal drinage and hence quick drying, and whereby the major portion of said support arm resists warping due to its specific orientation parallel to said plane disposed substantially transverse to the longitudinal axis of said base means, said base means comprises a laterally extending base wall and at least two side walls connected to and extending outwardly from said base wall to thereby define a substantially laterally extending elongated channel means extending between said side walls along a major portion of the length thereof, said side walls disposed in vertically spaced relation therebetween so that one of said side walls lies in a horizontal plane spaced upwardly of the other of said side walls lying in a horizontal plane parallel thereto, at least one pair of longitudinally spaces support arm receiving slots formed in said upper one of said side walls, each of said slots complementally formed relative to said support arms to snugly receive predetermined ones of said support arms, said lower wall having at least one pair of longitudinally spaced depending mounting flanges in substantial vertical alignment with predetermined ones of said slots so that each of said pairs of support arms is pivotally connected substantially adjacent one end thereof to predetermined ones of said depending mounting flanges to the end that disposing said support arm in a substantially upstanding or closed position results in said support arms being folded transversly into said channel means and being snugly longitudinally spaced slots individual to each support arm.

2. A support device of the type primarily designed to dispose footwear in exposed, supported position for drying, said support device comprising: base means dimensioned and configured for secure mounting engagement with predetermined surface, a pair of spaced support arms each said support arms individually secured to said base and disposed to extend outwardly therefrom in spaced relation to said base means, each of said support arms comprising a substantially elongated, generally flat, rectangular configuration, each of said support arms pivotally connected substantially adjacent one and thereof and comprising a footwear engaging distal end at the opposite end thereof and movably opposite ends thereof and movable in a plane disposed substantially parallel to the longitudinal axis of said base means between an open and a closed position, said open position defined by outward, angularly oriented disposition of said arms relative to said base means, said closed position defined by a substantially co-linear relation between the longitudinal axis of said support arms and said base means, each of said support arms having a substantially 90° twist formed therein about its longitudinal axis substantially adjacent said footwear engaging distal end so that said distal end lies on a plane orthogonally disposed to said plane disposed substantially transverse to the longitudinal axis of said base means, the portion of each said support arm intermediate its distal free end and said twisted portion angularly disposed relation to the longitudinal axis of said support arm so that it lies in a substantially horizontal plane thereby supporting footwear in an optimal position to achieve maximal drainage and hence quick drying, and whereby the major portion of said support arm resists warping due to its specific orientation parallel to said plane disposed substantially transverse to the longitudinal axis of said base means, said base means comprises an elongate upstanding base wall and at least two side walls connected thereto and extending upwardly therefrom to define an elongate upstanding channel means extending between said side walls along the major portion of the height thereof, a transversely disposed slot defining plate means disposed adjacent the uppermost free end of said channel means, substantially centrally thereof to thereby provide a pair of longitudinally spaced slot members for snugly receiving therein predetermined ones of said support arms when said support arms are disposed in an upstanding or closed position, each of said support arms being pivotally connected substantially adjacent one end thereof to the end of said side walls remote from said uppermost free end, said slots defined between opposing ends of said transversely disposed plate and associated ones of said side walls, said pivotal connection of each of said support arms being interior of said channel means so that said support arms and said slots are in substantial vertical alignment with one another, whereby each support arm is pivotal longitudinally into said channel means and is snugly retained in such position at least in part by said slot individual to each support rm.

* * * * *

UNITED STATES PATENT AND TRADEMARK OFFICE

CERTIFICATE OF CORRECTION

PATENT NO. : 4,289,243

DATED : September 15, 1981

INVENTOR(S) : Nicholas A. Arbuzoff

It is certified that error appears in the above-identified patent and that said Letters Patent are hereby corrected as shown below:

Title of Patent should be: --SUPPORT DEVICE PRIMARILY DESIGNED FOR FOOTWEAR--.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*